US006042204A

United States Patent [19]

Quirch et al.

[11] Patent Number: 6,042,204

[45] Date of Patent: Mar. 28, 2000

[54] FORMS ORGANIZER

[76] Inventors: Eduardo J. Quirch, 6792 Brookline Dr., Miami, Fla. 33015; Jesus Sanchelima, 235 SW. Le Jeune Rd., Miami, Fla. 33134

[21] Appl. No.: 09/245,464

[22] Filed: Feb. 5, 1999

[51] Int. Cl.[7] ..... A47B 88/00

[52] U.S. Cl. ..... 312/273; 312/301

[58] Field of Search ..... 312/271, 273, 312/301, 298, 272

[56] References Cited

U.S. PATENT DOCUMENTS

| | | | |
|---|---|---|---|
| 1,204,568 | 11/1916 | Harnesberger | 312/301 |
| 3,171,701 | 3/1965 | Stark | 312/273 |
| 3,318,648 | 5/1967 | Schonenbach | 312/273 |
| 3,328,104 | 6/1967 | Schreyer | 312/301 |

FOREIGN PATENT DOCUMENTS

| | | | |
|---|---|---|---|
| 5543 | of 1889 | United Kingdom | 312/301 |

*Primary Examiner*—Peter M. Cuomo
*Assistant Examiner*—Gerald A. Anderson
*Attorney, Agent, or Firm*—J. Sanchelima

[57] ABSTRACT

An organizer for forms that includes a housing with front and rear openings and several guiding members mounted within the housing at a predetermined spaced apart relationship with respect to each other and designed to slidably accept trays of cooperative rectangular dimensions so that the trays are kept at parallel and spaced apart relationship with respect to each other. Each tray has a rear side with a predetermined number of cut-outs. Plates are mounted over the cut-outs to selectively provide an edge closer to the rear of the tray than the edge of the cut-out. The tray with the post member or members causes other linked trays to make the forms contained therein available to a user at once. Actuating post members can be removably mounted on the plates to cause other trays having plates to move when the actuating post member pushes them.

5 Claims, 2 Drawing Sheets

FORMS ORGANIZER

BACKGROUND OF THE INVENTION

1. Field of the Invention

The present invention relates to an organizer for forms, and more particularly, to the type that can be adjusted to cause related forms to be brought out simultaneously.

2. Description of the Related Art

In a typical office, such as insurance agency offices, many different forms are used. Not infrequently, some of the forms are related to others and need to be used simultaneously. Thus, the desirability of having a device that can store the forms frequently used on separate trays for each form while allowing one or more of the trays to be coupled to other trays containing related forms so that a group of related forms can be made selectively available.

None of the devices known to the applicant include the features claimed in the present application.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that can store a number of forms in a volumetrically efficient manner.

It is another object of this invention to provide a device that includes a number of trays that can be programmed to have some trays adapted to move others simultaneously when a governing tray is pulled.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
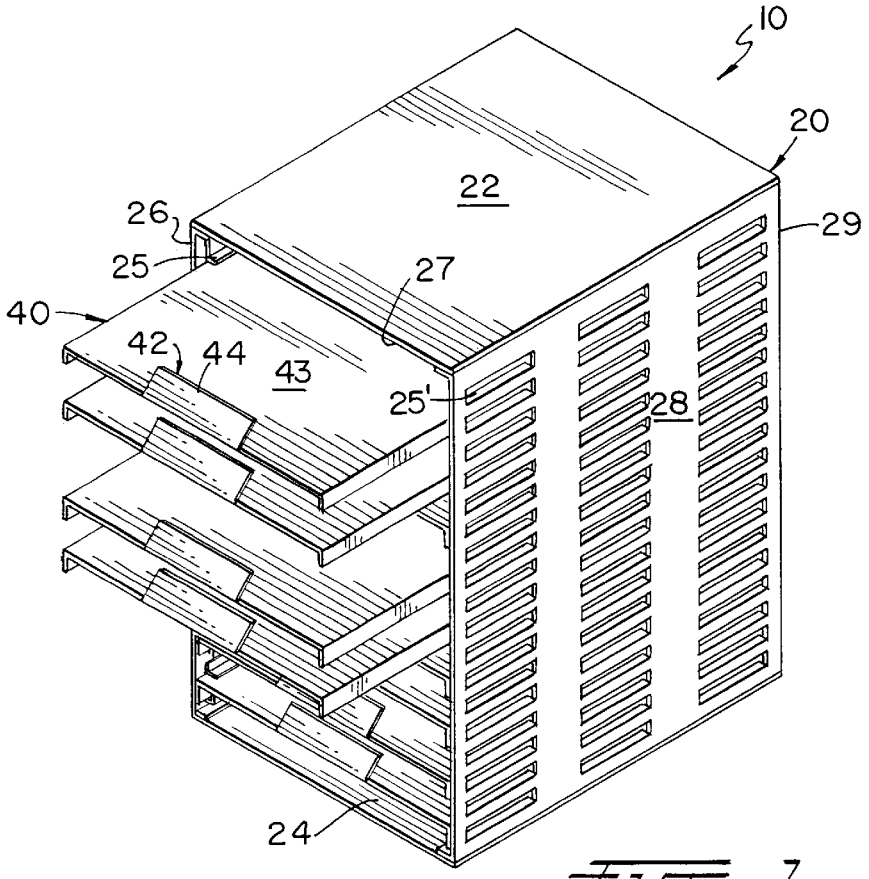
FIG. 1 represents an isometric view of one of the preferred embodiments of the present invention.
Figure 2:
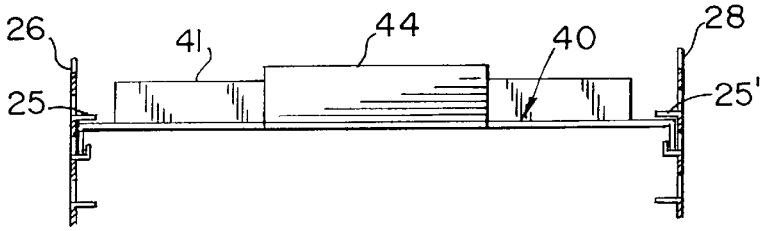
FIG. 2 shows a front view of one of the trays slidably inserted in the channel formed by the guiding member pairs.

Referring now to the drawings, where the present invention is generally referred to with numeral 10, it can be observed that it basically includes housing 20 with top wall 22, bottom wall 24 and side walls 26 and 28, perpendicularly disposed with respect to each other and defining a front opening 27 and rear opening 29 as best seen in FIG. 1. A predetermined number of guiding member pairs 25 and 25' are mounted on side walls 26 and 28 inside housing 20 and adapted to slidably receive tray assemblies 40 as seen in FIG. 2.

Housing 20 has a rectangular cross-section to accommodate tray assemblies 40 that have dimensions slightly larger than the sheets of paper they support. Tag support assembly 42 is mounted, preferably at an angle, at the front end of tray assemblies 40. Surface 44 is sufficiently large to permit a user to mount (with glue, pressure, sensitive adhesives, or other means) a tag with the pertinent information (typically identifying the forms contained in the corresponding tray assembly 40). Stopper member 41 is mounted on top surface 43 of tray assembly 40 and it is designed to prevent the forms from sliding to the rear.

The rear end of tray assemblies 40 include rear edge 46 with cut-outs 48. Removable plates 50 are designed to mount to slots 51 selectively covering one or more cut-outs 48. Removable actuating post 60 is firmly mounted on the edges 46 of tray assemblies 40 extending perpendicularly therefrom either downwardly or upwardly. Actuating post 60 is positioned along edge 46 of a governing tray assembly 40' so that adjacent tray assemblies 40 are either pulled out (driven tray assemblies) or not moved (the ones with cut-outs 48 that coincide with the path of post member 60). Thus, a user may program adjacent tray assemblies by covering or not covering cut -outs 48 with removable plates 50. Cut-outs 48 are sufficiently deep to permit tray assemblies 48 with the covered cut-outs to travel a sufficient predetermined distance before removable post member 60 actuates the tray assemblies with the uncovered cut-outs 48.

Other equivalent mechanisms can be used to selectively cover cut-outs 48, such snap-on covers, tapes, etc. The main ojective being to selectively cover cut-outs 48 when a given tray assembly 40 is to be linked to a governing tray having an actuating post 60 mounted on one of the governing plates 50'. Plates 50' are provided with eyelet 54 through which actuating post 60 is mounted so that it is projected perpendicularly and adjacent to the rearmost edge of plates 50 for abutting engagement thereto.

Figure 3:
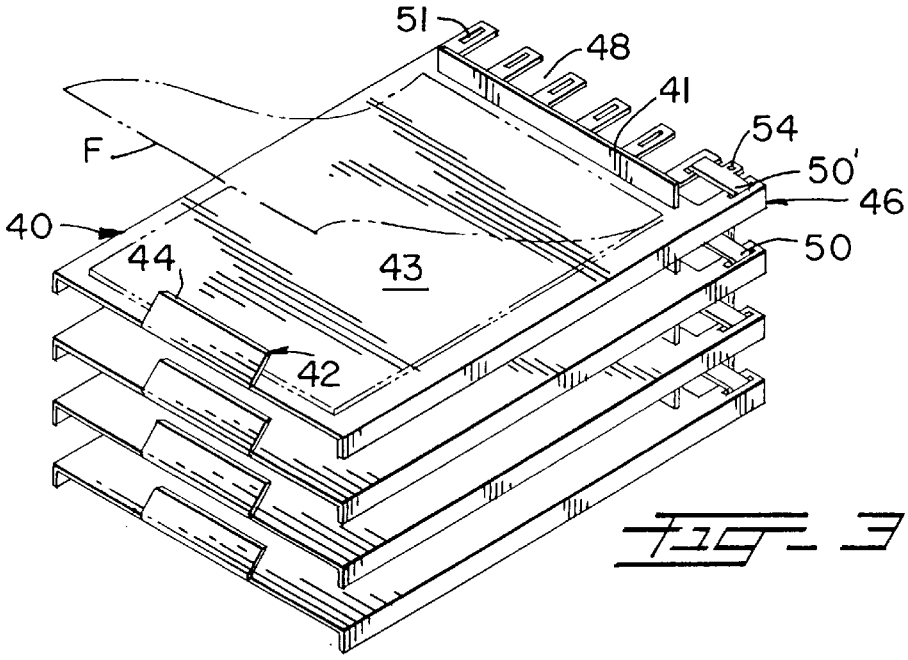
FIG. 3 is an isometric view of several trays with a governing tray controlling other driver trays.
Figure 4:
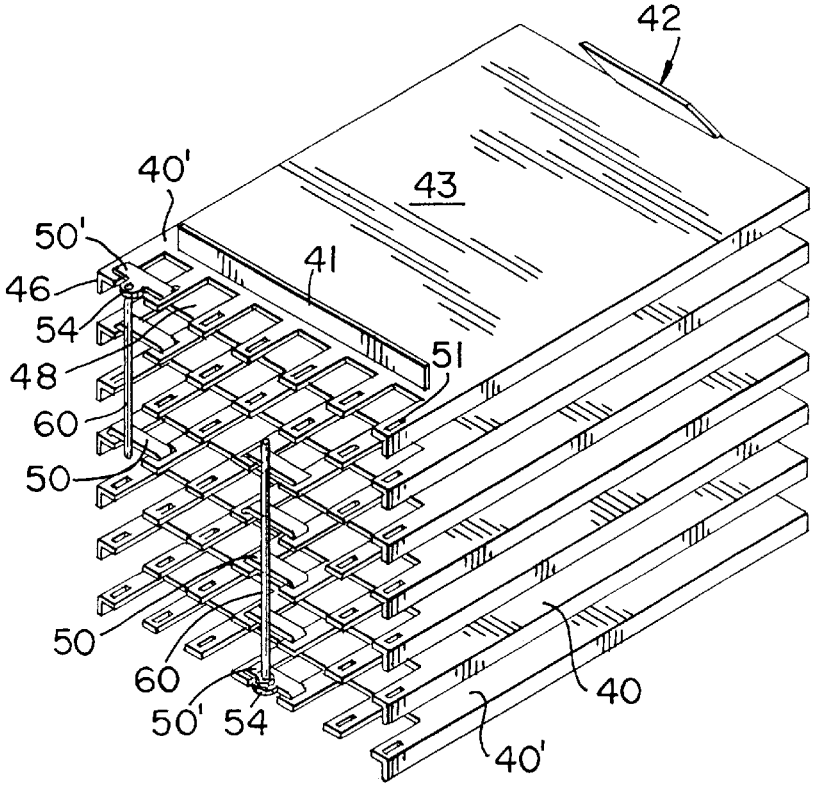
FIG. 4 represents an isometric view from the rear showing several trays programmed to be driven by actuating posts where the cut-outs have been covered.

In FIG. 3, several tray assemblies 40 are shown from the front at an angle with forms F in phantom. FIG. 4 is an inclined rear view. As it can be seen, governing tray 40' includes governing plate 50' that carries actuating post 60 to selectively come in abutting contact with plates 50.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An organizer for forms comprising:

A) a housing having top, bottom, and two side walls and defining front and rear openings;

B) a plurality of guiding means mounted within said housing and spaced apart with respect to each other;

C) a plurality of trays having cooperative dimensions to be slidably received by said guiding means so that said trays are kept at parallel and spaced apart relationship with respect to each other and each tray having a front edge and a rear edge, each rear edge including at least one cut-out;

D) removable means for selectively covering said cut-outs; and

E) an actuating post member mounted to the rear edge of at least one of said trays, said post member extending perpendicularly from said tray and adjacent to the rear edge of at least one of the other trays and coinciding with at least one of said cut-outs so that when a tray mounting one said actuating post member is moved forward the adjacent trays with the coinciding cut-outs covered by said removable members are also moved by said actuating post member to protrude partially from said housing.

2. The organizer set forth in claim 1 wherein said actuating post member is mounted to one of said cut-out covering removable means.

3. The organizer set forth in claim 2 wherein said removable means for selectively covering said cut-outs includes a plurality of plates that provide a rear edge to said cut-outs having an abutting relationship with at least of one said actuating post members.

4. The organizer set forth in claim 3 wherein each of said trays includes a display mounted on said front edge.

5. The organizer set forth in claim 4 wherein each of said trays includes a stopper member transversally disposed on the upper surface of said trays so that a form resting thereon is not allowed to slide to the rear of said tray beyond said stopper member.

* * * * *